US006243010B1

(12) United States Patent
Addy et al.

(10) Patent No.: US 6,243,010 B1
(45) **Date of Patent: *Jun. 5, 2001**

(54) ADAPTIVE CONSOLE FOR AUGMENTING WIRELESS CAPABILITY IN SECURITY SYSTEMS

(75) Inventors: Kenneth L. Addy; Karl Linford, both of Massapequa, NY (US)

(73) Assignee: Pittway Corp., Chicago, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,545

(22) Filed: Jan. 8, 1998

(51) Int. Cl.[7] ..... G08B 1/08

(52) U.S. Cl. ..... 340/539; 340/531; 340/533; 340/825.36; 340/825.49; 340/825.06; 340/825.31; 340/825.32

(58) Field of Search ..... 340/506, 539, 340/531, 533, 825.06, 825.36, 825.32, 825.49, 825.31

(56) References Cited

U.S. PATENT DOCUMENTS 4,772,876 * 9/1988 Laud ..... 340/539
5,543,778 * 8/1996 Stouffer ..... 340/539

* cited by examiner

*Primary Examiner*—Daryl Pope
(74) *Attorney, Agent, or Firm*—Greenberg Traurig, LLP; Anthony R. Barkume

(57) ABSTRACT

A security system comprising a plurality of remote wireless units, a central control unit and an adaptive console for translating messages in radio frequency signals into messages in signals suitable for transmission over a wire in order to augment the wireless capability of the system. The adaptive console has a wireless receiver for receiving the radio frequency signal, which includes identification and status information from a wireless remote units. The adaptive console also has a processing unit which translates the identification and status information from the radio frequency signal to corresponding function data derived from a mapping of valid identification and status information to function data, the function data emulating data generated by keypresses on a keypad that is representative of a function to be performed by the security system. The adaptive console also has a transmitter which transmits a signal over a wired connection which includes the corresponding function data to the central control unit or a wired security unit. The adaptive console may additionally have components enabling it to receive a signal from a wired connection, translate that signal to valid identification and status information, and then transmit a second radio frequency signal to the wireless remote units. Alternatively, the central control unit may contain the mapping and perform the translation from valid identification and status information to function data.

54 Claims, 6 Drawing Sheets

ADAPTIVE CONSOLE FOR AUGMENTING WIRELESS CAPABILITY IN SECURITY SYSTEMS

BACKGROUND OF THE INVENTION

This invention relates to security systems, and in particular to a method and apparatus for increasing the number of wireless devices/identification codes to which a wired or wireless security system will respond.

FIG. 1 illustrates a typical wired security system 10 of the prior art comprising a central control unit 12, a central transceiver 14, a console display/keypad 18, a plurality of remote sensors 20 and local sensors 22, a telephone dialer 24 and a siren 26. The remote sensors 20 are hard-wired to the central transceiver 14, which communicates with the central control unit 12 via a system bus 28. The system bus 28 also links the central control unit 12 to the console display/keypad 18. The central control unit 12 is connected to the telephone dialer 24 and the siren 26 via an auxiliary local bus 30. The central control unit is also hardwired to the local sensors 22. Despite a lack of wireless capability (i.e., wireless communication between components, especially between the remote sensors 20 and the central control unit 12), this type of wired security system 10 prevails in a majority of commercial applications.

In contrast, a relatively recent innovation in security systems is a wireless security system 32 as illustrated in FIG. 2 in which wireless remote sensors 21 communicate with a wireless central receiver 15 in order to report their status to the central control unit 12. Wireless keys 34, which are small remote control devices, have become popular for remote arming and disarming of the wireless security system 32, as well as remote control of other devices via the wireless central receiver 15 and central control unit 12. As shown in FIG. 2, the conventional wireless security system 32 is substantially functionally the same as the wired security system 10 illustrated in FIG. 1, except that the wireless central receiver 15, an optional wireless central transmitter 17, and wireless remote sensors 21 have been substituted for their wired counterparts of FIG. 1. In addition, the wireless key 34 transmits control messages to the wireless central receiver 15. The wireless central receiver 15 transfers these control messages over the system bus 28 to the central control unit 12, which performs an appropriate action or function. Such appropriate action may involve the initiation of an alarm condition that then sounds the siren 26 and causes the telephone dialer 24 to automatically dial an appropriate number such as the police station or firehouse. Substantially any change in status of the wireless security system 32 would be displayed to the user on the console display/keypad 18.

One of the major advantages of a wireless security system is a reduction in installation time due to the fact that the wireless remote sensors 21 do not require wiring back to the wireless central receiver 15. However, the local bus 30 and the system bus 28 must still be hard-wired and the wireless central receiver 15. Wireless central transmitter 17 and console display/keypad 18 must be assigned unique system bus addresses to avoid contention on the shared system bus 28. In a similar manner, an identification code for each of the wireless remote sensors 21 as well as the wireless key 34 must be "learned" by the central control unit 12. The identification code 36, as illustrated in FIG. 6, represents a portion of a radio frequency or wireless message 38 transmitted by each of the wireless remote sensors 21 and wireless key 34, and is used to distinguish between them.

The process of learning the identification codes (i.e. initializing the system) involves causing the wireless remote sensors 21 and the wireless key 34 to transmit their respective radio frequency message 38 while denoting the validity of the wireless message 38 received by depressing a button or buttons on the console display/keypad 18, which also assigns a corresponding function to be performed upon receipt of each of the valid identification codes. The learning process results in the storage of a set of valid identification codes mapped to specific functions for each wireless remote sensor 21 and wireless key 34 of the wireless security system 32 in the central control unit 12 of the wireless security system of the prior art illustrated in FIG. 2.

Despite the fact that the same identification code may be emitted by more than one wireless key (as found with automobile security systems where more than one wireless key provided to the purchaser of the automobile can control the security system), this is typically not the case with the majority of wireless security systems installed in commercial businesses and residential homes. Wireless keys 34 typically have two or more buttons which, although will emit the same identification code 34 upon being depressed, will emit different radio frequency messages differentiated in one or more status bits 40. Therefore, a significant problem is encountered in providing sufficient storage space to maintain the complete set of valid identification and status information mapped to functions for a wireless security system of any reasonable size. This problem is compounded by the fact that existing central control units 12 found in wireless security systems include only a very limited storage area for this type of information. Furthermore, in the case of wired security systems 10 without wireless capability, such as that illustrated in FIG. 1, there is understandably no such storage whatsoever. This problem is not present in conventional wired systems because such systems are not required to respond to radio frequency messages.

One solution to this problem has been to replace existing security systems with a unit that includes the wireless central receiver 15, wireless central transmitter 17, console display/keypad 18 and central control unit 12 including a larger identification code storage area in one unit. Such a unit must be placed near an access way to the secured building in order to provide an auxiliary means for the user to arm or disarm the system upon entering or leaving the premises as a failsafe backup to the wireless key 34. In addition, since the wireless central receiver is contained in the unit, the unit must be installed in a central location to facilitate adequate reception and transmission of radio frequency signals from the wireless remote sensors 21 and wireless key 34. However, a significant disadvantage results in that the unit, due to its location near an access or entry way, becomes particularly susceptible to destruction by an intruder before it has an opportunity to initiate an alarm condition. For this reason, many professional security installers are unwilling to install such a unit, preferring to keep the central control unit 12 physically separate from the receiver, transmitter and console. Furthermore, many users choose not to reinstall an entirely new unit due to the associated cost.

Therefore, it would be advantageous if a practical and affordable solution to interfacing with existing security systems could be designed which would supplement a limited or nonexistent storage area for identification codes already located in the central control unit while maintaining adequate reception and transmission of wireless radio frequency signals.

The spread of wireless technology in the,manufacture of security systems has been delayed significantly due to consumers' preference for wired systems. This is partially due to the vast quantity of wired security systems 10, such as that illustrated in FIG. 1, already in existence and partially due to various perceived disadvantages with wireless security systems, such as the need to replace batteries, poor reception and transmission of wireless signals, etc. Thus, the user having a wired security system 10 already installed without any wireless capability is not likely to install a wireless security system, even though he might benefit from the many advantages associated with a wireless security system such as the absence of wires as well as ease of installation, maintenance and upgrade. Likewise, many installers of security systems choose not to offer wireless security systems because of their relative inexperience with such systems in addition to the disadvantages already discussed.

Therefore, it would be advantageous if a method were developed whereby existing non-wireless ready wired security system could be retrofitted, thereby providing wireless capability to such units in an unobtrusive, inexpensive, and practical manner.

Many of the wireless security systems currently in use are limited in the number of identification codes 36 that can be recognized by the system. As illustrated in FIG. 2 and discussed above, the wireless key 34 is a common element in the typical wireless security system 32. The wireless key 34 may have four buttons, each initiating a different function within the wireless security system 10, such as arming/disarming of the system, opening a garage door, emergency alert and testing, via transmission of a unique radio frequency message in response to depression of a different button. For security purposes and ease of manufacture, each wireless key 34 will be designed to transmit a unique radio frequency message in response to depression of each button. Such a configuration can rapidly outpace the capacity for storage of valid identification and status information built into existing central control units 12.

Therefore, it would be advantageous if a method were developed which could supplement the number of wireless identification codes recognizable by an existing wireless security system in an efficient, unobtrusive and inexpensive manner.

SUMMARY OF THE INVENTION

In accordance with the present invention, a method and apparatus is provided for augmenting the wireless capability of a security system, which comprises receiving a radio frequency signal comprising identification and status information, translating the identification and status information derived from the radio frequency signal to corresponding function data derived from a mapping of valid identification and status information to function data, the function data emulating data generated by keypresses on a keypad that is representative of a function to be performed by the security system, and transmitting the function data over a wired connection.

In further accordance with the present invention, the method and apparatus receive from a wired connection a second signal comprising second function data to be performed by the security system, translate the second function data to corresponding valid identification and status information derived from the mapping of valid identification and status information to function data, and transmit a second radio frequency signal comprising the corresponding valid identification and status information.

In still further accordance with the present invention, the method and apparatus program the mapping of valid identification and status information to function data by entering function data corresponding to receipt of the radio frequency signal, the function data comprising keypress information, associate the identification and status information in the radio frequency signal with the keypress information in the function data, and store the identification and status information with the keypress information, thereby generating the mapping of valid identification and status information to function data.

In further accordance with the present invention, a security system is provided comprising a plurality of wireless remote units, a control unit, and an adaptive console. The adaptive console comprises a receiver module which receives a radio frequency signal comprising identification and status information from the plurality of wireless remote units, a processing module which translates the identification and status information from the detected radio frequency signal to corresponding function data derived from a mapping of valid identification and status information to function data, mapping memory which stores the mapping of valid identification and status information to function data, a console display/keypad module which enables a user to program the mapping of valid identification and status information to function data, and a transmitter module which transmits a signal suitable for transmission over a wire comprising the corresponding function data to the control unit. The adaptive console optionally comprises a second receiver module which receives a second signal suitable for transmission over a second wire comprising second function data to be performed by the security system from the control unit, the processing module translating the second function data in the second signal suitable for transmission over a second wire to corresponding valid identification and status information derived from the mapping of valid identification and status information to function data, and an optional second transmitter module which transmits a second radio frequency signal comprising the corresponding valid identification and status information to the plurality of wireless remote units.

In further accordance with the present invention, the central control unit contains the mapping of valid identification and status information to function data and performs the translation after having received the identification and status information from the adaptive console. The adaptive console having already verified the validity and format of the message in the received radio frequency signal prior to transmission to the central control unit.

DETAILED DESCRIPTION OF THE PREFERRED EMBODIMENT

Figure 1:
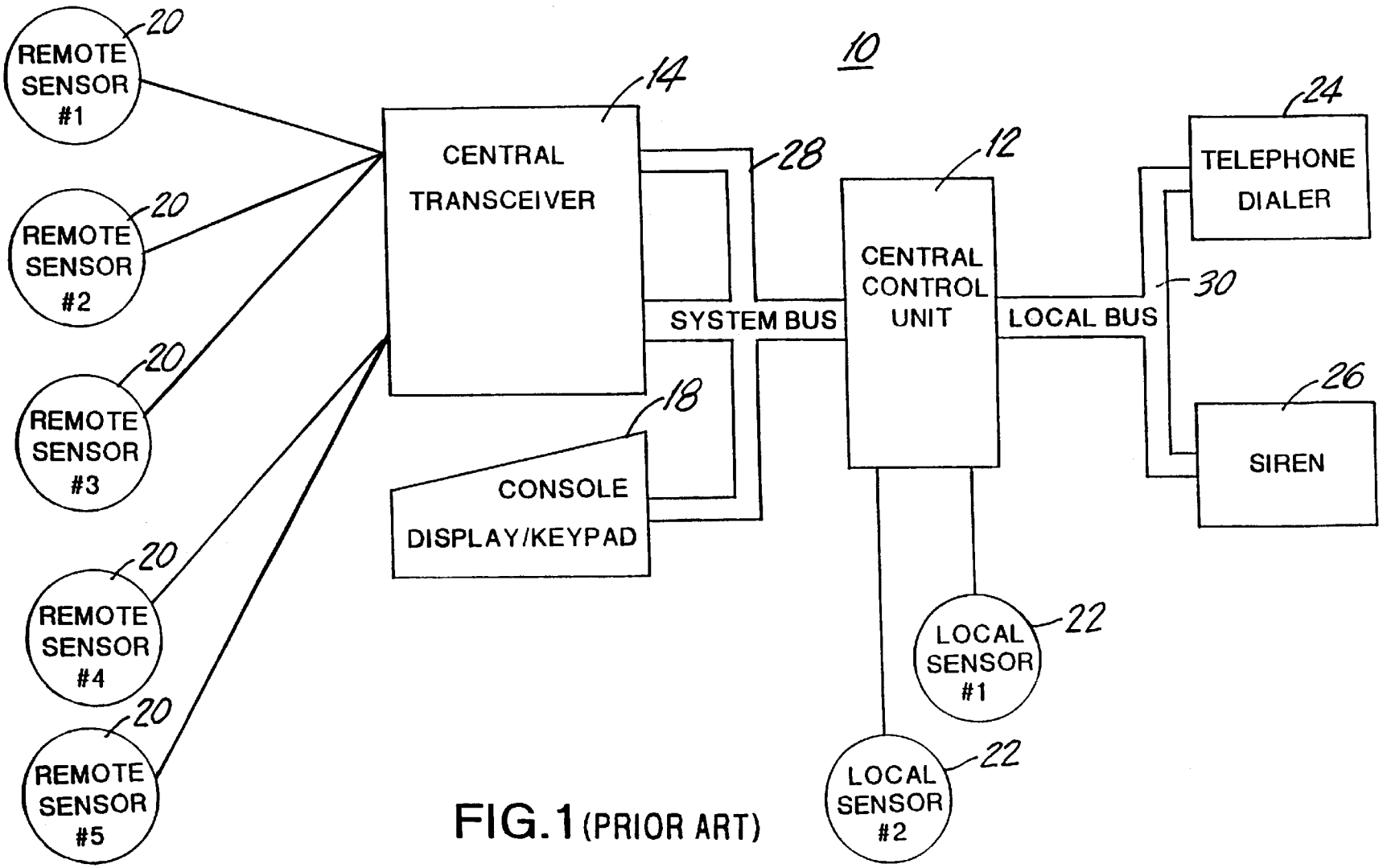
FIG. 1 (PRIOR ART)
FIG. 1 illustrates a block diagram of a wired security system of the prior art.
Figure 2:
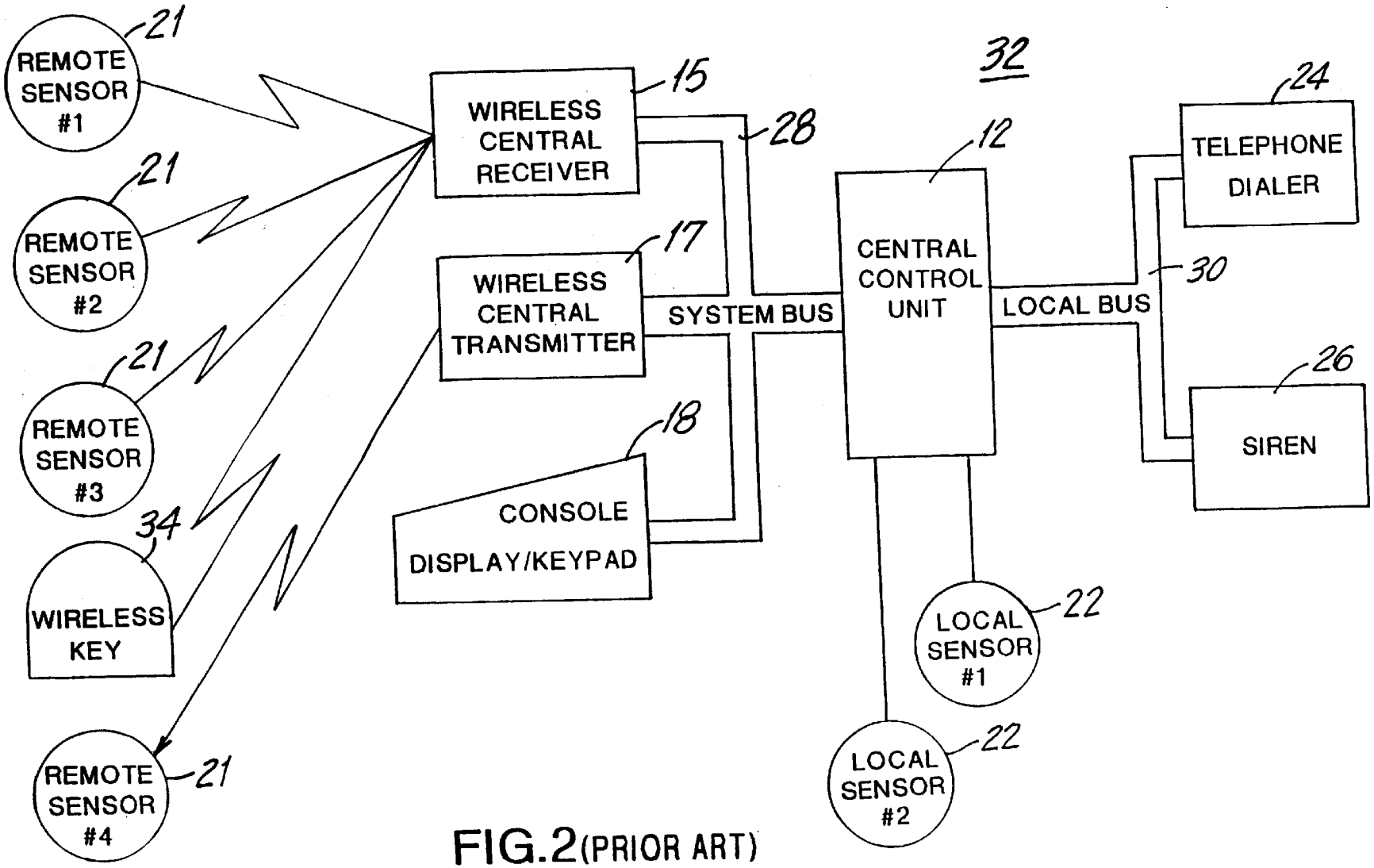
FIG.2(PRIOR ART)
FIG. 2 illustrates a block diagram of a wireless security system of the prior art.
Figure 3:
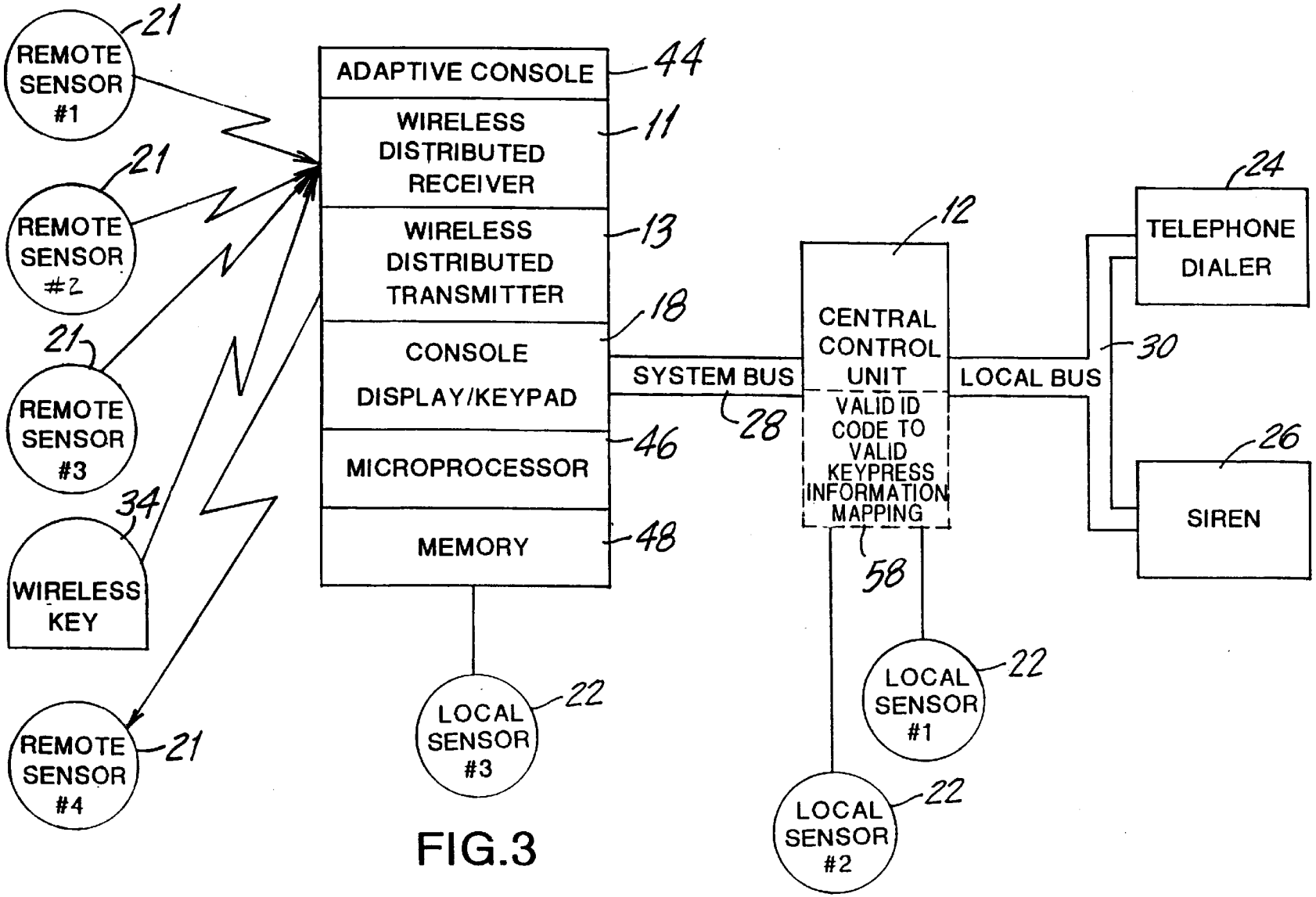
FIG. 3 illustrates a block diagram of a wireless security system utilizing an adaptive console of the present invention.

FIG. 3 illustrates a composite wireless security system 42 comprising each of the components of the wireless security system 32 of FIG. 2 with the substitution of an adaptive console 44 of the present invention for the wireless distributed receiver 11, wireless distributed transmitter 13 and console display/keypad 18. Each of the wireless distributed receiver 11, wireless distributed transmitter 13 and console display/keypad 18 within the adaptive console 44 is separately addressable via a system bus 28, just as the corresponding units are in existing security systems. Therefore, the adaptive console 44 is designed to operate as an efficient "drop in" compatible replacement or supplement for these elements in new and existing wired and wireless security systems such as those shown in FIGS. 1 and 2, respectively.

In the wired security system 10 of FIG. 1 the existing central transceiver 14 and console display/keypad 18 could be removed along with the hard-wired remote sensors 20, enabling the adaptive console 44 to be installed with a new set of wireless remote sensors 21 and wireless key 34. The wireless remote sensors 21 comprise garage door openers, PIR detectors, shock detectors, glass break detectors, smoke detectors and other security units well known in the art. In so doing, the previously wired security system could be provided with wireless capability. Alternatively, any or each of the central transceiver 14 and console display/keypad 18 could be retained in the system and the adaptive console 44 added with additional wireless remote sensors 21 and wireless keys 34, resulting in a hybrid system having increased wireless capability.

In the wireless security system 32 of FIG. 2 the existing wireless central receiver 15, wireless central transmitter 17 and console display/keypad 18 could be removed, enabling the adaptive console 44 to be installed with the another or additional set of wireless remote sensors 21 and wireless keys 34. In so doing the existing wireless security system 32 is upgraded to enable response to a greater number of identification codes and, therefore, is able to respond to a greater number of wireless remote sensors 21 and wireless keys 34. Alternatively, any or each of the wireless central receiver 15, wireless central transmitter 17 and console display/keypad 18 could be retained in the system and the adaptive console 44 added, resulting in the ability of the security system to respond to an even greater number of wireless remote sensors 21 and wireless keys 34 while saving identification and status information storage area or zones inherent in the existing central control unit 12 for additional identification and status information. In such an embodiment an attempt would first be made to verify the identification code in the adaptive console 44. If the verification was unsuccessful the identification code could then optionally be passed to the central control unit 12 for verification against the identification and status information area stored in the central control unit 12 or it could be discarded as invalid.

A commercially available example of the wireless security components is provided by a 5800 series manufactured by Alarm Device Manufacturing Co., located in Syosset, N.Y. Specifically, a 5881 wireless receiver receives radio frequency messages from a 5804 wireless key and passes the complete message (in digital format) to a central control panel or unit in order to be decoded, checked for validity, and ultimately perform a pre-programmed function. In addition, bi-directional wireless keys, such as a 5804BD wireless key, transmit information to the central control unit and receive an acknowledgment back via a 5800TM central transmitter module, which transmits to a receiver contained within the 5804BD wireless key. Thus, the 5804BD bi-directional wireless key provides feedback to the user by indicating system status via lights and tones on the 5804BD enabling the following:

1. remote arming of the security system upon leaving the premises with confirmation that the process was successful;
2. remote verification of the security status for the occurrence of an alarm condition in order to be able to react if necessary; and
3. remote verification that the security system has been disarmed to eliminate false alarms upon authorized entry.

It is anticipated that despite the ability of the adaptive console 44 to access the central control unit 12 via the system bus 28, the adaptive console 44 is not required to do so in all cases. For instance, in a central control unit bypass mode, the wireless key 34 may transmit identification and status information which, upon receipt by the wireless distributed receiver 11, prompts the adaptive console 44 to transmit a command via the wireless distributed transmitter 13 to one of the wireless remote sensors 21 responsible for opening a garage door or another wired security unit well known in the art. Such a process could be carried out without any intervention by the central control unit 12.

Although one embodiment of the adaptive console 44 comprises the wireless distributed receiver 11, the wireless distributed transmitter 13, the console display/keypad 18, and processing means such as a microprocessor 46 and a memory 48, an alternative embodiment of the adaptive console 44 comprises the wireless distributed receiver 11, the microprocessor 46, and the memory 48 with or without the console display/keypad 18. Such an embodiment would provide wireless capability in the receive direction only. An additional embodiment of the adaptive console 44 comprises the wireless distributed transmitter 13, the microprocessor 46, the memory 48 with or without the console display/keypad 18. Such an embodiment would provide wireless capability in the transmit direction only.

The fact that the adaptive console 44 communicates to the central control unit 12 via a hard-wired system bus 28 permits the adaptive console 44 to be mounted in a convenient location near access ways and away from the central control unit. In this way, the wireless distributed receiver 11 and wireless distributed transmitter 13 are located near the wireless remote sensors 12, enabling improved reception and transmission of wireless signals. In addition, maintaining a reasonable distance between the combination of the central control unit 12, siren 26, and telephone dialer 24 and any access ways ensures that the combination of the central control unit, siren and telephone dialer can alert the proper authorities prior to an opportunity to destroy them by an intruder entering one of the access ways. Such an installation overcomes the disadvantages of the prior art solution involving the self contained unit which combines the functionality of the central control unit 12 and the adaptive console 44 into one physical unit as described above.

Figure 4:
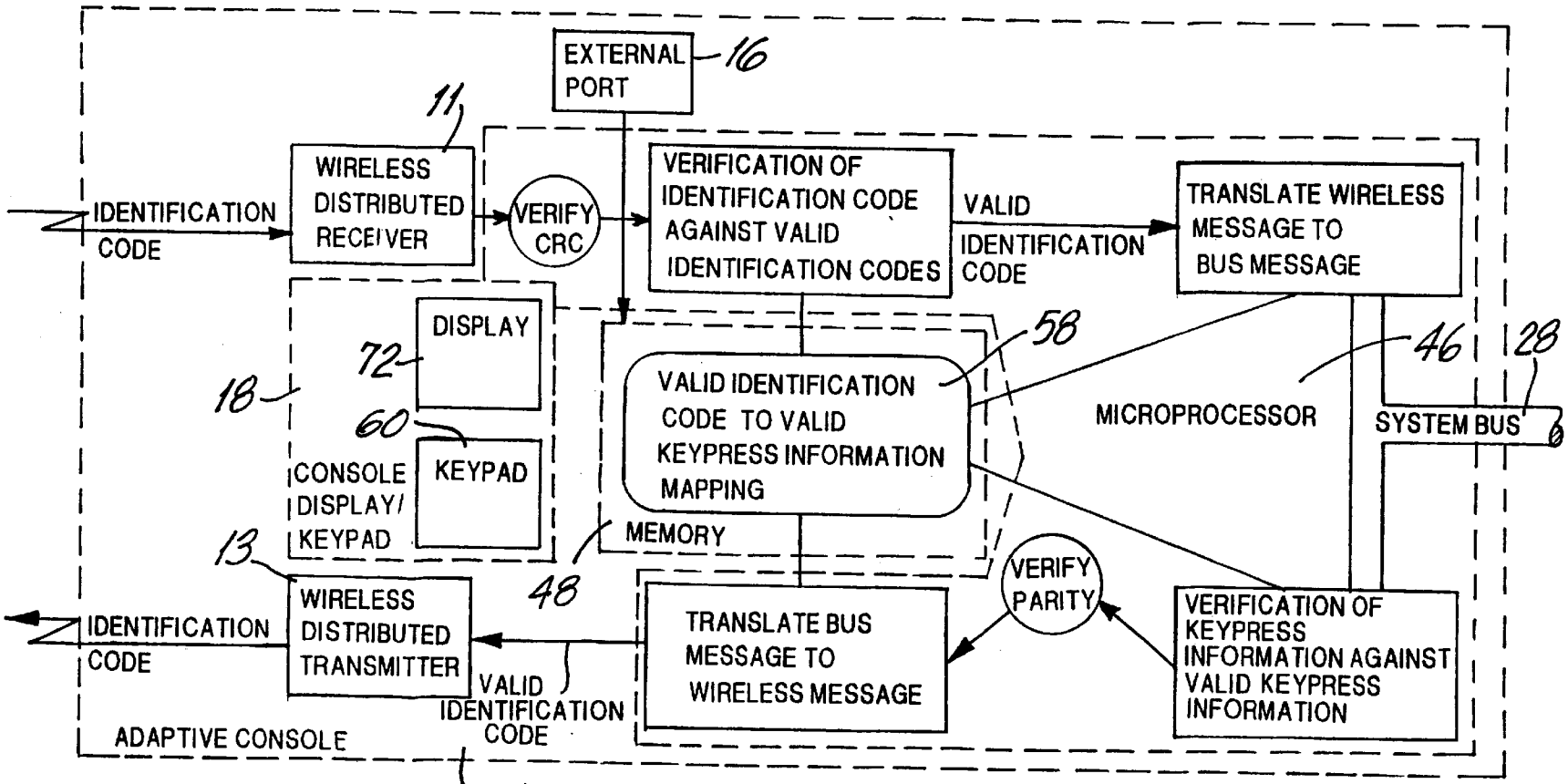
FIG. 4 illustrates a block diagram of the adaptive console of FIG. 3.
Figure 6:
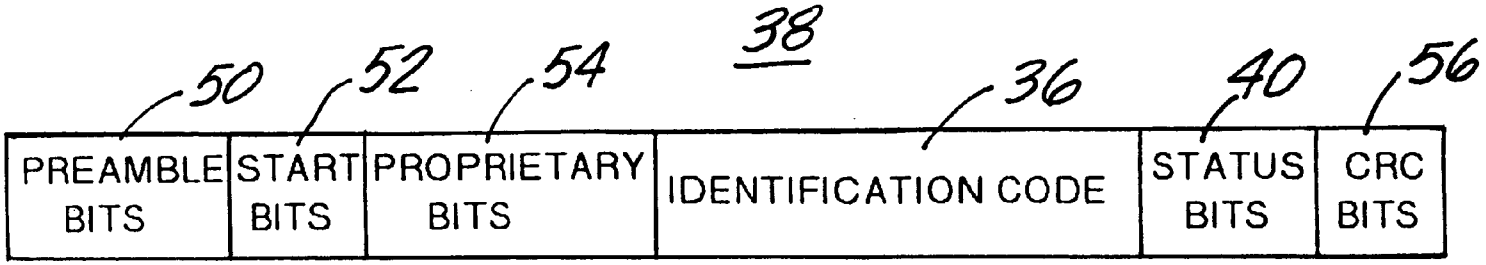
FIG. 6 illustrates a format of a wireless message.

The block diagram of FIG. 4 illustrates the operation of the adaptive console 44 in greater detail. A wireless message 38 of the type illustrated in FIG. 6 is transmitted by one or more of the remote sensors 21 in the radio frequency band and is received by the wireless distributed receiver 11 by means which are well known in the art. The wireless message 38 is comprised of preamble bits 50, start bits 52, proprietary bits 54, the identification code 36, status bits 40 and CRC bits 56. In the preferred embodiment, Manchester data encoding is used to encode a data word by means well known in the art as follows; the message commences with the preamble bits 50, which are used by the wireless distributed receiver 11 to extract timing information and to indicate that the wireless message follows. The preamble 50 is followed by the start bits 52 which indicate the start of the wireless message 38; this is followed by proprietary bits 54 which are used to indicate a particular manufacturer, system code that the system maintains a proprietary rather than open standard. The identification code 36 uniquely identifies the source of a wireless message 38 received by the adaptive console 44, or the destination of the wireless message 36 transmitted by the adaptive console 44. The status bits 40 indicate various information; for example, the status of the battery and the identity of the button on the wireless key 34 that was depressed. This is followed by CRC bits 56 which are used for error checking of the wireless message 38 by means well known in the art.

Upon conversion of the wireless message 38 by the wireless distributed receiver 11 to a form suitable for subsequent processing, the CRC bits 56 are verified to ensure that there were no errors in transmission, and the identification code 36 and status bits 40 are verified against a set of valid identification codes and status bits stored in memory 48 as a valid identification code to valid function mapping 58. Such a mapping 58 provides not only a list of the identification codes and status bits currently recognized as valid, but also the function to be performed by the security system upon receipt of the particular identification code and status bit combination. The functions comprise arming and disarming the security system, opening a garage door, entering a test mode, sounding an emergency state, etc.

Such a mapping 58 will have been entered into the adaptive console 44 during a learning phase. In the learning phase the user or installer will cause one of the wireless remote sensors 21 to transmit its wireless message comprising a particular identification code 36. Simultaneously or at some predetermined time thereafter, the user enters the function on the console display/keypad 18 that he wishes to be associated with the particular identification code 36 contained in the wireless message being transmitted. Alternatively, the function could be entered first via the console display/keypad 18 followed by the identification code 36. It is anticipated that the function will be represented in the form of keypress information 62 originating from a keypad 60 and displayed to the user on a display 72 by means well known in the art. In this way, the mapping 58 between valid identification codes 36 and the corresponding functions that the user determines should be performed upon receipt of each of the valid identification codes 36 is generated and may be stored in memory 48. The mapping 58 is used to determine the function corresponding to a given identification code 36 as well as to determine the identification code 36 corresponding to a given function expressed in terms of keypress information 62. Alternatively, an existing or external keypad and display may be used to program the mapping via an external port 16.

Figure 7:
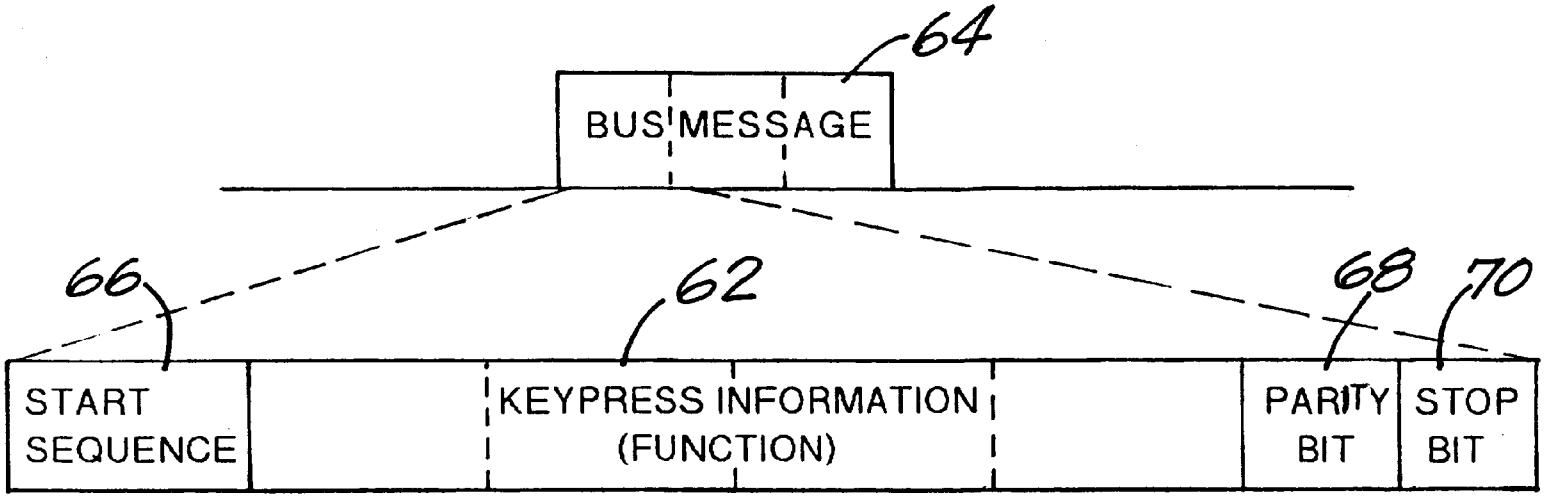
FIG. 7 illustrates a format of a system bus message.

Once the corresponding function is obtained from the mapping 58, the adaptive console 44 will utilize the keypress information 62 associated with the identification code 36 from the received wireless message 38 and incorporate it into a system bus message 64 as shown in FIG. 7. The system bus message 64 is then transferred to the central control unit 12 via the system bus. Therefore, the adaptive console 44 of the present invention may be used to simulate the keypress information or output of the console display/keypad 18 which is hard-wired to the central control unit 12 as shown in FIGS. 1 and 2.

As illustrated in FIG. 7, the system bus message 64 comprises 3 words, each comprising a start sequence 66, the keypress information 62, a parity bit 68, and a stop bit 70. The system bus message 64 is transmitted between the adaptive console 44 and the central control unit 12. Prior to transmission of the system bus message 64, a polling signal (not shown) is typically transmitted by the central control unit 12 which requests an update of information from the adaptive console 44. The polling signal typically comprises system bus addressing information to enable individualized polling of units in communication with the system bus 28 peripheral to the central control unit 12 and to prevent contention on the system bus 28 between these peripherals (e.g., multiple adaptive consoles 44, wireless distributed receivers 15, wireless distributed transmitters 17 and central control units 12).

Similarly, the process described immediately above is performed in reverse order to transmit a wireless message 38, wherein the system bus message 64 from the central control unit 12 is verified with respect to parity and valid keypress information in the mapping 58. The identification code 36 and status bits 40 corresponding to the valid keypress information is incorporated into the wireless message 38 and transmitted by the wireless distributed transmitter 13 to any of the remote wireless sensors 21 or wireless keys 34. Thus, the adaptive console 44 is able to process wireless messages 38 into system bus messages 64 and system bus messages 64 into wireless messages 38 without using wireless capabilities in the existing central control unit 12. This effectively creates wireless capability within existing wired security systems or enables existing wireless security systems to respond to a greater number of wireless remote sensors and wireless keys.

Figure 5:
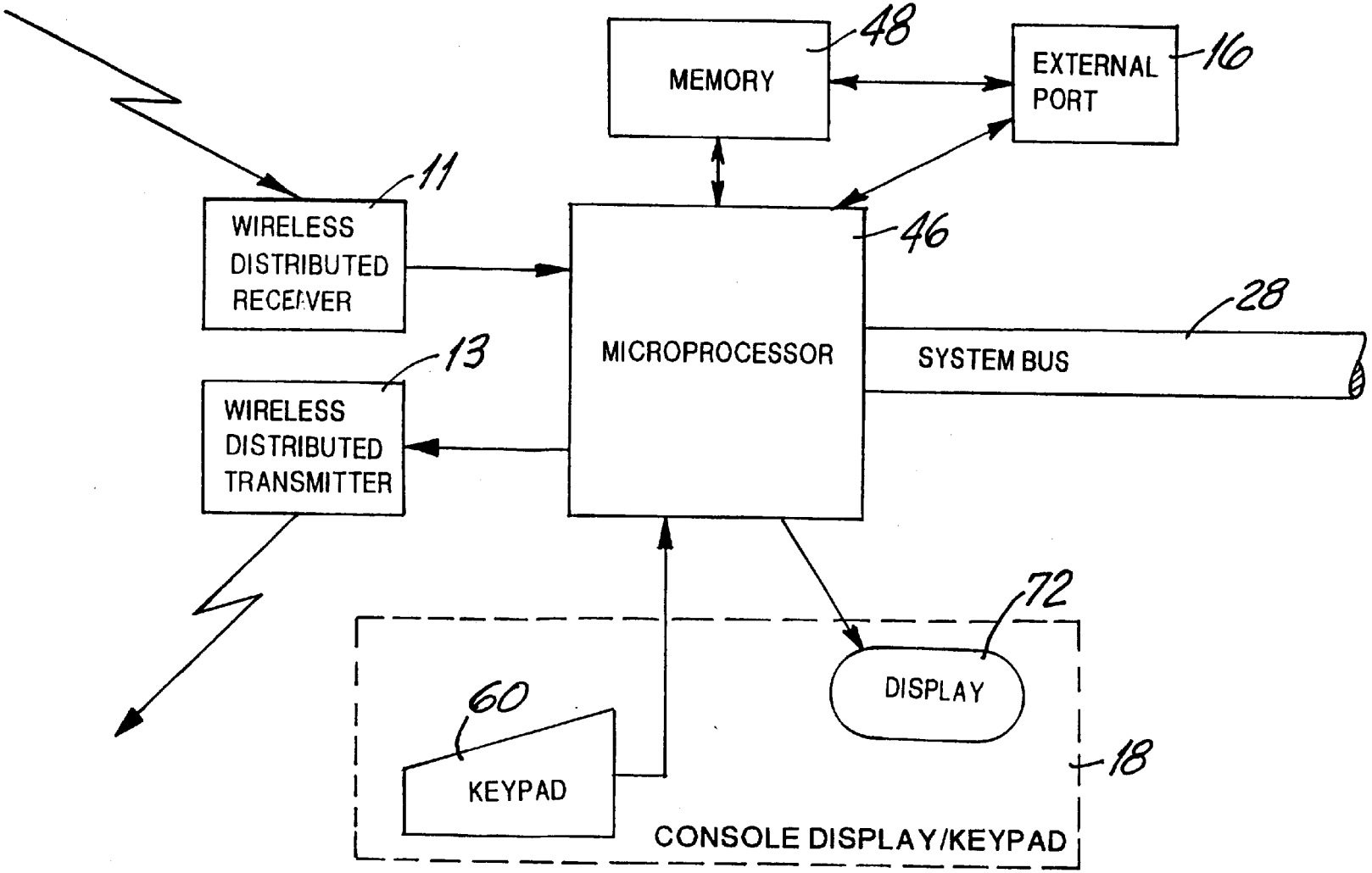
FIG. 5 illustrates a block diagram of a hardware embodiment of the adaptive console of FIG. 4.

FIG. 5 illustrates a hardware embodiment of the adaptive console 44 of FIG. 4 comprising the wireless distributed receiver 11, wireless distributed transmitter 13, console display keypad 18, and memory 48. As indicated on FIG. 4, the microprocessor 46 verifies the CRC, parity, keypress information, and identification code and status bits by comparison with the mapping 58 stored in memory 48. In addition, the microprocessor 46 translates the system bus message 64 to the wireless message 38 and the wireless message 38 to the system bus message 64. The same or an additional microprocessor or microcontroller may be used to monitor input and output from the wireless distributed receiver 11 and wireless distributed transmitter 13. The mapping 58 is entered into memory 48 via the learning process described above using the keypad 60 and display and driver 72.

An alternative embodiment of the present invention comprises optionally storing the partial or complete mapping 58 in the central control unit 12 as shown in FIG. 3. As described above a partial mapping 58 would be stored in the central control unit 12 in circumstances where the adaptive console 44 is being used to augment existing wireless capability in the existing wireless security system as illustrated in FIG. 2. A complete mapping 58 would be stored in the central control unit in situations where the wireless capability of the existing central control unit 12 is sufficient and the identification and status information storage area in the adaptive console 44 is not required. In these embodiments the wireless distributed receiver 11 would receive the incoming wireless message and transfer it to the microprocessor 46 which verifies the CRC, timing and format of the wireless message 38 in order to determine if the incoming message is valid or a result of interference. If the timing, format and CRC are valid then the content of the wireless message 36 is transmitted over the system bus 28 to the central control unit 12, where it is compared against the mapping 58 in a manner similar to that described above and illustrated in FIG. 4 except that the process is performed in the central control unit 12 rather than the adaptive console 44. Upon validation of the identification code 36 the appropriate function is performed. An advantage to retaining the mapping 58 entirely within the central control unit 12 is the relative simplicity of downloading updates and revisions to the mapping 58 via modem through the attached telephone and dialer 24 without the necessity of transferring the downloaded data over the system bus 28 to the adaptive console 44. Alternatively, if a portion of the mapping 58 or the complete mapping 58 were retained in the adaptive console 44, the mapping 58 could be revised in a similar manner with the additional step of reformatting and transmitting the downloaded data over the system bus 28.

One advantage of these embodiments is an improvement in the location of the wireless distributed receiver 11. In alarm systems of the prior art the wireless central receiver 15 is located near the central control unit 12, such as in a basement, where radio frequency propagation is poor. By locating the wireless distributed receiver 11 away from the central control unit 12 (such as in the living space near an entry or exit way), radio frequency propagation between the wireless distributed receiver 11 and the remote sensors 21 will be improved. In addition, the wireless key 34, which comprises an antenna exhibiting only a very limited range, is generally operated by the user as he approaches an entry or exit way and the decrease in distance between the wireless key 34 and the wireless distributed receiver 11 will clearly improve this propagation as well. Similarly, locating the wireless distributed transmitter 13 with the wireless distributed receiver 11 will improve transmission to and from the adaptive console 44 to bi-directional wireless key such as the 5804BD described above. Since the antenna within the 5804BD has only a limited range, locating the adaptive console 44 closer to the area in which the 5804BD is likely to be activated will improve propagation.

Although the invention has been shown and described with respect to best mode embodiments thereof, it should be understood by those skilled in the art that the foregoing and various other changes, omissions and additions in the form and detail thereof may be made therein without departing from the spirit and scope of the invention.

What is claimed is:

1. A method for augmenting the wireless capability of a security system, which comprises the steps of:

receiving a radio frequency signal comprising identification and status information;

translating said identification and status information derived from said radio frequency signal to corresponding function data derived from a mapping of valid identification and status information to function data, said function data emulating data generated by keypresses on a keypad that is representative of a function to be performed by said security system; and transmitting said function data over a wired connection.

2. The method of claim 1, wherein said step of transmitting said function data comprises transmitting said function data via a wire to a wired security unit.

3. The method of claim 1, wherein said step of transmitting said function data comprises transmitting said function data via a wire to a central control unit.

4. The method of claim 1, further comprising the step of performing a verification of the accuracy of said message in said radio frequency signal.

5. The method of claim 1, wherein said step of transmitting further comprises transmitting said identification and status information derived from said radio frequency signal over said wired connection to a central control unit upon failure to find said corresponding function data in said mapping of valid identification and status information to function data, said step of translating said identification and status information to corresponding function data performed in said central control unit.

6. The method of claim 1, further comprising receiving from a wired connection second function data indicative of a function to be performed by said security system;

translating said second function data to corresponding valid identification and status information derived from said mapping of valid identification and status information to function data; and transmitting a second radio frequency signal comprising said corresponding valid identification and status information to a wireless security device.

7. The method of claim 6, wherein said second function data is received from a wired security unit.

8. The method of claim 6, wherein said step of receiving said second function data is received from a central control unit.

9. The method of claim 6, wherein said step of translating said second function data further comprises:

deriving said second function data from said second signal suitable for transmission over a second wire;

indexing into said mapping of valid identification and status information to function data with said second function data;

obtaining said valid identification and status information corresponding to said second function data; and converting said second signal suitable for transmission over a second wire into said second radio frequency signal comprising said corresponding valid identification and status information.

10. The method of claim 1, further comprising an initial step of programming said mapping of valid identification and status information to function data.

11. The method of claim 10, wherein said step of programming further comprises entering function data by a user corresponding to receipt of said radio frequency signal, said function data comprising keypress information;

associating said identification and status information in said radio frequency signal with said keypress information in said function data;

storing said identification and status information in association with said keypress information, thereby generating said mapping of valid identification and status information to function data.

12. The method of claim 1, wherein said step of translating further comprises:

converting said radio frequency signal into a converted signal;

deriving said identification and status information from said converted signal;

indexing into said mapping of valid identification and status information to function data with said identification and status information;

obtaining said function data representative of a function to be performed by said security system corresponding to said identification and status information; and converting said converted signal into said signal suitable for transmission over a wire comprising said corresponding function data.

13. An adapter for augmenting the wireless capability of a security system, which comprises:

means for receiving a radio frequency signal, said radio frequency signal comprising identification and status information;

means for translating said identification and status information from said received radio frequency signal to corresponding function data derived from a mapping of valid identification and status information to function data, said function data emulating data generated by keypresses on a keypad that is representative of a function to be performed by said security system; and means for transmitting a signal suitable for transmission over a wire comprising said corresponding function data.

14. The adapter of claim 13, wherein said means for transmitting said signal suitable for transmission over a wire is adapted to transmit said signal suitable for transmission over a wire to a wired security unit.

15. The adapter of claim 13, wherein said means for transmitting said signal suitable for transmission over a wire is adapted to transmit said signal suitable for transmission over a wire to a central control unit.

16. The adapter of claim 13, further comprising means for verifying accuracy of said message from said radio frequency signal.

17. The adapter of claim 13, wherein said signal suitable for transmission over said wire further comprises said identification and status information derived from said radio frequency signal, said signal suitable for transmission over said wire being transmitted to a central control unit upon failure to find said corresponding function data in said mapping of valid identification and status information to function data, said central control unit comprising a second means for translating said identification and status information to corresponding function data.

18. The adapter of claim 13 further comprising:

means for receiving a second signal suitable for transmission over a second wire comprising second function data to be performed by said security system;

means for translating said second function data in said second signal suitable for transmission over a second wire to corresponding valid identification and status information derived from said mapping of valid identification and status information to function data; and means for transmitting a second radio frequency signal comprising said corresponding valid identification and status information.

19. The adapter of claim 18, wherein said means for receiving said second signal suitable for transmission over a second wire is adapted to receive said second signal suitable for transmission over a second wire from a wired security unit.

20. The adapter of claim 18, wherein said means for receiving said second signal suitable for transmission over a second wire is adapted to receive said second signal suitable for transmission over a second wire from a central control unit.

21. The adapter of claim 13, further comprising means for programming said mapping of valid identification and status information to function data.

22. The adapter of claim 21, wherein said means for programming further comprises a keypad and a display.

23. The adapter of claim 22, wherein a user enters function data on said keypad corresponding to receipt of said radio frequency signal by said means for receiving said radio frequency signal, said function data comprising keypress information, said means for programming associating said identification and status information in said radio frequency signal with said keypress information in said function data, said means for programming storing said identification and status information with said keypress information, thereby generating said mapping of valid identification and status information to function data.

24. An adapter for augmenting the wireless capability of a security system, which comprises:

a receiver which receives a radio frequency signal comprising identification and status information;

a processing unit which translates said identification and status information in said radio frequency signal to corresponding function data derived from a mapping of valid identification and status information to function data, said function data emulating data generated by keypresses on a keypad that is representative of a function to be performed by said security system; and a transmitter which transmits a signal suitable for transmission over a wire comprising said corresponding function data.

25. The adapter of claim 24, wherein said transmitter is adapted to transmit said signal suitable for transmission over a wire to a wired security unit.

26. The adapter of claim 24, wherein said transmitter is adapted to transmit said signal suitable for transmission over said wire to a central control unit.

27. The adapter of claim 24, wherein said processing unit verifies accuracy of said message in said radio frequency signal.

28. The adapter of claim 24, wherein said transmitter transmits said identification and status information derived from said radio frequency signal over said wire to a central control unit upon failure to find said corresponding function data in said mapping of valid identification and status information to function data, said central control unit comprising a second processing unit which translates said identification and status information to corresponding function data.

29. The adapter of claim 24, further comprising:

a second receiver which receives a second signal suitable for transmission over a second wire comprising second function data to be performed by said security system;

a second processing unit which translates said second function data in said second signal suitable for transmission over a second wire to corresponding valid identification and status information derived from said mapping of valid identification and status information to function data; and a second transmitter which transmits a second radio frequency signal comprising said corresponding valid identification and status information.

30. The adapter of claim 29, wherein said second receiver is adapted to receive said second signal suitable for transmission over a second wire from a wired security unit.

31. The adapter of claim 29, wherein said second receiver is adapted to receive said second signal suitable for transmission over a second wire from a central control unit.

32. The adapter of claim 24, further comprising a programming unit which enables said mapping of valid identification and status information to function data to be programmed.

33. The adapter of claim 32, wherein said programming unit further comprises a keypad and a display.

34. The adapter of claim 33, wherein a user enters function data on said keypad corresponding to receipt of said radio frequency signal by said receiver, said function data comprising keypress information, said programming unit associating said identification and status information in said radio frequency signal with said keypress information in said function data, said programming unit storing said identification and status information with said keypress information, thereby generating said mapping of valid identification and status information to function data.

35. The adapter of claim 33, wherein said processing unit comprises a microprocessor and memory.

36. An integral adaptive unit for augmenting the wireless capability of a security system, which comprises:

a receiver module which receives a radio frequency signal comprising identification and status information;

a processing module which translates said identification and status information in said radio frequency signal to corresponding function data derived from a mapping of valid identification and status information to function data, said function data emulating data generated by key presses on a keypad that is representative of a function to be performed by said security system;

mapping memory which stores said mapping of valid identification and status information to function data;

a console display/keypad module which enables a user to program and view said mapping of valid identification and status information to function data; and a transmitter module which transmits a signal suitable for transmission over a wire comprising said corresponding function data.

37. The integral adaptive unit of claim 36, wherein said transmitter module is adapted to transmit said signal suitable for transmission over a wire to a wired security unit.

38. The integral adaptive unit of claim 36, wherein said transmitter module is adapted to transmit said signal suitable for transmission over a wire to a central control unit.

39. The integral adaptive unit of claim 36, wherein said processing module verifies accuracy of said message in said radio frequency signal using cyclic redundancy checks.

40. The integral adaptive unit of claim 36, wherein said signal suitable for transmission over said wire further comprises said identification and status information derived from said radio frequency signal, said signal suitable for transmission over said wire being transmitted to a central control unit upon failure to find said corresponding function data in said mapping of valid identification and status information to function data, said central control unit comprising a second processing module which translates said identification and status information to corresponding function data.

41. The integral adaptive unit of claim 36, further comprising a second receiver module which receives a second signal suitable for transmission over a second wire comprising second function data to be performed by said security system;

a second processing module which translates said second function data in said second signal suitable for transmission over a second wire to corresponding valid identification and status information derived from said mapping of valid identification and status information to function data; and a second transmitter module which transmits a second radio frequency signal comprising said corresponding valid identification and status information.

42. The integral adaptive unit of claim 41, wherein said second receiver module is adapted to receive said second signal suitable for transmission over a second wire from a wired security unit.

43. The integral adaptive unit of claim 41, wherein said second receiver module is adapted to receive said second signal suitable for transmission over a second wire from a central control unit.

44. The integral adaptive unit of claim 36, wherein a user enters function data on said keypad corresponding to receipt of said radio frequency signal by said receiver module, said function data comprising keypress information, said processing module associating said identification and status information in said radio frequency signal with said keypress information in said function data and storing said identification and status information with said keypress information in said mapping memory, thereby generating said mapping of valid identification and status information to function data.

45. A security system comprising:

a plurality of wireless remote units;

a control unit; and an adaptive console comprising a receiver module which receives a radio frequency signal comprising identification and status information from said plurality of wireless remote units, a processing module which translates said identification and status information in said radio frequency signal to corresponding function data derived from a mapping of valid identification and status information to function data, said function data emulating data generated by keypresses on a keypad that is representative of a function to be performed by said security system, mapping memory which stores said mapping of valid identification and status information to function data, a console display/keypad module which enables a user to program said mapping of valid identification and status information to function data, a transmitter module which transmits a signal suitable for transmission over a wire comprising said corresponding function data to said control unit, said transmitter module transmitting said signal suitable for transmission over said wire comprising said identification and status information upon failure to find said identification and status information in said mapping of valid identification and status information to function data;

a second receiver module which receives a second signal suitable for transmission over a second wire comprising second function data to be performed by said security system from said control unit, said processing module translating said second function data in said second signal suitable for transmission over a second wire to corresponding valid identification and status information derived from said mapping of valid identification and status information to function data, and a second transmitter module which transmits a second radio frequency signal comprising said corresponding valid identification and status information to said plurality of wireless remote units.

46. The security system of claim 45, wherein said transmitter module is adapted to transmit said signal suitable for transmission over a wire to a wired security unit.

47. The security system of claim 45, wherein said processing module verifies accuracy of said message in said radio frequency signal using cyclic redundancy checks.

48. The security system of claim 45, wherein said second receiver module is adapted to receive said second signal suitable for transmission over a second wire from a wired security unit.

49. The security system of claim 45, wherein a user enters function data on said console display/keypad corresponding to receipt of said radio frequency signal by said receiver module, said function data comprising keypress information, said processing module associating said identification and status information in said radio frequency signal with said keypress information in said function data and storing said identification and status information with said keypress information in said mapping memory, thereby generating said mapping of valid identification and status information to function data.

50. A security system comprising:

a plurality of wireless remote units;

an adaptive console comprising a receiver module which receives a radio frequency signal comprising identification and status information from said plurality of wireless remote units, a transmitter module which transmits a signal suitable for transmission over a wire comprising said identification and status information;

a second receiver module which receives a second signal suitable for transmission over a second wire comprising second identification and status information to be performed by said security system, and a second transmitter module which transmits a second radio frequency signal comprising said identification and status information to said plurality of wireless remote units; and a control unit comprising a processing module which translates said identification and status information in said signal suitable for transmission over said wire transmitted from said transmitter module to corresponding function data derived from a mapping of valid identification and status information to function data, said function data emulating data generated by keypresses on a keypad that is representative of a function to be performed by said security system, mapping memory which stores said mapping of valid identification and status information to function data.

51. The security system of claim 50, wherein said control unit further comprises a console display/keypad module which enables a user to program said mapping of valid identification and status information to function data.

52. The security system of claim 50, wherein said transmitter module is adapted to transmit said signal suitable for transmission over a wire to a wired security unit.

53. The security system of claim 50, wherein said adaptive console further comprises a second processing module which verifies accuracy of said message in said radio frequency signal using cyclic redundancy checks.

54. The security system of claim 50, wherein said second receiver module is adapted to receive said second signal suitable for transmission over a second wire from a wired security unit.

* * * * *